United States Patent [19]

Shigenobu et al.

[11] Patent Number: 4,544,828

[45] Date of Patent: Oct. 1, 1985

[54] HEATING DEVICE

[75] Inventors: Michio Shigenobu, Tokyo; Hiroshi Satomura, Saitama, both of Japan

[73] Assignee: Canon Kabushiki Kaisha, Tokyo, Japan

[21] Appl. No.: 523,622

[22] Filed: Aug. 15, 1983

Related U.S. Application Data

[63] Continuation of Ser. No. 238,565, Feb. 26, 1981, abandoned.

[30] Foreign Application Priority Data

Mar. 3, 1980 [JP] Japan ..... 55-27064
Mar. 3, 1980 [JP] Japan ..... 55-27065

[51] Int. Cl.[4] ..... H05B 3/10

[52] U.S. Cl. ..... 219/216; 29/612; 106/228; 219/469; 219/505; 219/543; 219/553; 252/507; 252/520; 338/22 SD; 338/327

[58] Field of Search ..... 219/216, 505, 553, 469, 219/543, 470, 471; 338/21, 22 R, 22 SD, 23, 25, 327; 252/502, 504, 507, 519, 520; 29/610 R, 611, 612, 621; 106/228 B, 228 Q

[56] References Cited

U.S. PATENT DOCUMENTS

| | | | |
|---|---|---|---|
| 3,426,250 | 2/1969 | Kahn | 252/520 X |
| 3,533,966 | 10/1970 | Moratis | 338/22 R X |
| 3,586,642 | 6/1971 | Matsuo et al. | 252/520 |
| 3,666,505 | 5/1972 | Hoffman et al. | 252/520 X |
| 3,673,092 | 6/1972 | Dietz | 252/520 |
| 3,706,582 | 12/1972 | Meyer | 252/520 X |
| 3,766,098 | 10/1973 | Masuyama et al. | 252/520 X |
| 4,001,145 | 1/1977 | Sakai et al. | 252/520 X |
| 4,103,274 | 7/1978 | Burgess et al. | 338/21 |
| 4,110,260 | 8/1978 | Yamamoto et al. | 252/519 |
| 4,232,214 | 11/1980 | Shioi et al. | 338/22 R |
| 4,245,146 | 1/1981 | Shioi et al. | 219/381 |
| 4,266,115 | 5/1981 | Dannatt | 219/216 |
| 4,302,361 | 11/1981 | Kotani et al. | 252/520 X |

*Primary Examiner*—Volodymyr Y. Mayewsky
*Attorney, Agent, or Firm*—Fitzpatrick, Cella, Harper & Scinto

[57] ABSTRACT

A heating device for heating an object with a heating element composed of ceramic particles having a positive temperature coefficient of resistance dispersed in a binder.

32 Claims, 9 Drawing Figures

HEATING DEVICE

This is a continuation of application Ser. No. 238,565 filed Feb. 26, 1981, now abandoned.

BACKGROUND OF THE INVENTION

1. Field of the Invention

The present invention relates to a heating device for heating an object, and more particularly to such a heating device adapted for use in a fixing apparatus for fixing an unfixed image in electrostatic printing, electrophotography, magnetography and the like, particularly such fixing apparatus as are designed for applying heat to an unfixed image to fix the same to an image bearing member.

2. Description of the Prior Art

In the field of heating elements there are already known ceramic materials having a positive temperature coefficient of electric resistance (hereinafter described as ceramics with PTC characteristics or PTC ceramics), and also known in the art are heating devices for image fixing utilizing such ceramic materials as the heat source.

Such PTC ceramics, capable of generating heat under a suitable voltage application, provide various advantages as the heat source in various heating devices, such advantages include a temperature self-control function without the external power control connected to a temperature detecting element, a limited variation in heat generation in response to the fluctuation in supplied voltage, and a long service life, etc. Also in the fixing apparatus for fixing a toner image they provide the advantages of rapid heating and shortened waiting time, in addition to those mentioned above.

However the PTC ceramics are associated with insufficient dimensional stability in the sintering and cooling steps, which becomes more marked as the molded products of PTC ceramics become larger in volume or in surface area. Also the PTC ceramics have difficulties in mechanical working such as scraping or grinding, so that the preparation of a relatively long roller or a relatively wide plate member with PTC ceramics for the fixing apparatus is practically quite difficult, giving rise to poor mass producibility and an elevated production cost. Furthermore the PTC ceramics tend to form cracks or local unevenness in quality in the sintering or cooling steps, particularly when they are large in volume or in surface area, thus becoming unable to provide uniform heat generation, over the surface of the heating element, or a desired amount of heat. In the fixing apparatus, such cracks or qualitative unevenness hinders the uniform heat application to the toner image or to the bearing member therefor, thus resulting in uneven or insufficient fixing.

SUMMARY OF THE INVENTION

The principal object of the present invention is to provide a heating device having a heating element capable of eliminating the above-mentioned drawbacks.

Another object of the present invention is to provide a heating device capable of sufficiently heating an object fully utilizing the characteristics of PTC ceramics.

Still another object of the present invention is to provide a heating device fully utilizing the characteristics of PTC ceramics and adapted for use in a fixing apparatus for uniform and high-speed fixation of a toner image onto an image bearing member.

DESCRIPTION OF THE PREFERRED EMBODIMENTS

Figure 1:
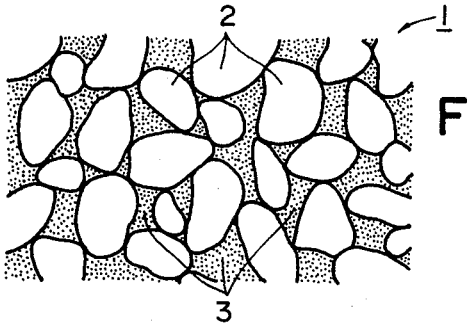
FIG. 1 is a magnified view of the heating element of the present invention.
Figure 2:
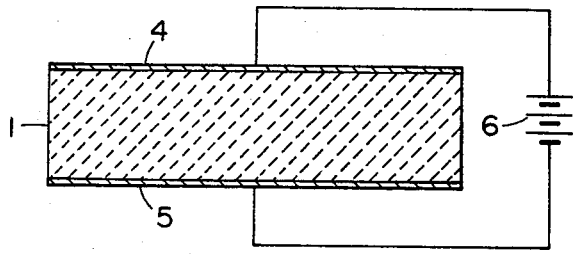
FIG. 2 is a schematic view showing the method of voltage application.

FIG. 1 shows, in a schematic magnified view, a part of the heating element 1 of the present invention, wherein particles 2 are obtained by crushing PTC ceramic material and mutually adhering the material with a binder 3 such as an insulating inorganic binder. In this manner the PTC ceramic particles 2 are so dispersed in the binder 3 that said particles are in mutual contact so as to exhibit an electric conductivity. Consequently the entire heating element 1 is rendered electrically conductive, and, upon application of a voltage thereto, each PTC ceramic particle 2 therein receives a voltage to generate heat, whereby the entire heating element 1 exhibits a PTC characteristic similar to that of the PTC ceramic bulk material dispersed therein. The voltage application to said heating element 1 can be achieved in a manner as shown in FIG. 2, wherein the voltage from a power source 6 is applied to electrode layers 4, 5 composed of silver, copper or nickel evaporated onto the top and bottom faces of the heating element 1. If the supplied voltage is so selected as to obtain a temperature close to the point of rapid increase in resistance of the heating element 1, the element performs a self-control function to maintain said selected temperature even when the actual voltage is different from the selected voltage, and reduces the electrical conductivity by the rapid increase in resistance in response to an eventual increase in temperature, thus realizing a substantially constant temperature.

As examples the heating elements were prepared from a $BaTiO_3$ PTC ceramic known under the trade name Posister or PTH (supplied by Murata Mfg. Co.) (A) which is crushed into particles of a size of 50 to 200$\mu$ and dispersed in 75 vol.% in an insulating inorganic binder principally composed of alumina and known under the trade name of Aron Ceramic D (Toa Gosei Kagaku Co., Ltd.), or (B) which is crushed into particles of 1 to 2 mm and likewise dispersed in 50 vol.% in said Aron Ceramic D, both followed by molding and hardening. The molding was achieved by uniformly applying the kneaded mixture of said ceramic particles and liquid Aron Ceramic D around a glass pipe of 40 mm in diameter and 320 mm in length, hardening by heating for 150 minutes at 150° C. and thereafter polishing the external surface with sandpaper of #600 and then sandpaper of #2000 to obtain a heating element of 2 mm in thickness. The dispersion of PTC ceramic particles in a binder enabled integral preparation of a large roll-structured heating element as mentioned above, with excellent working properties allowing precise dimensioning and shaping as desired. The obtained heating elements showed no cracks, and qualitative unevenness was not observed as the ceramic bulk material was crushed and blended in the binder.

Figure 3:
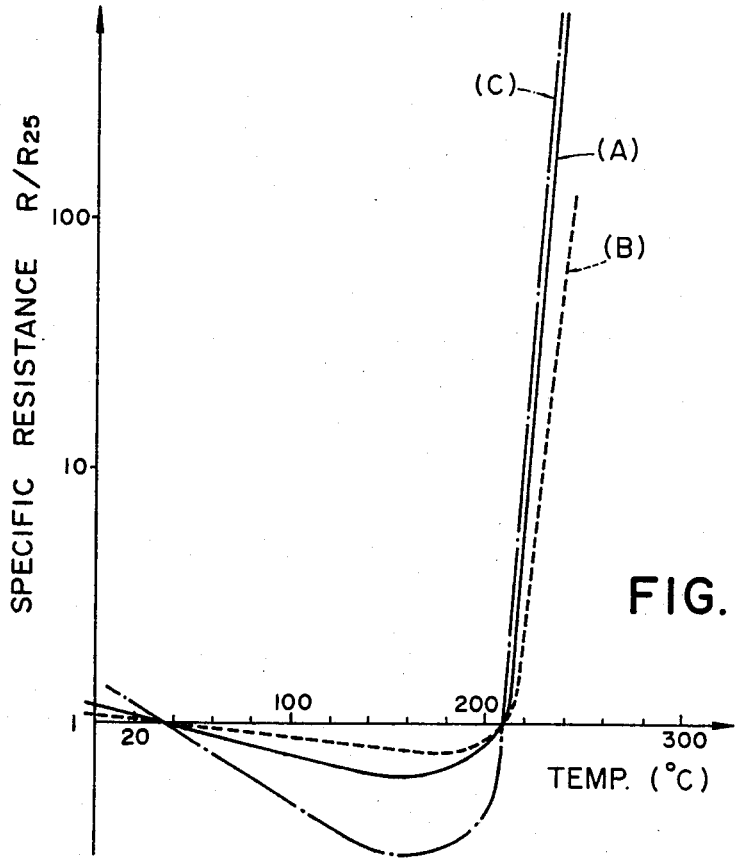
FIG. 3 is a chart showing the characteristic of an embodiment of the present invention.

FIG. 3 shows the specific resistivity, calculated as a ratio to the resistance at 25° C., of said heating elements (A) and (B) and said $BaTiO_3$ ceramic bulk material employed therein, represented as a function of temperature. It will be seen that the heating elements (A) and (B) show a PTC characteristic, with the point of rapid resistance increase around 210° C., as is observed with the ceramic bulk material (C).

The above-mentioned binder Aron Ceramic D may be replaced by a heat-resistant glass such as that known under the trade name Pyrex (Iwaki Glass Co., Ltd.). In this case the heat-resistant glass is crushed into particles, then mixed with the crushed particles of $BaTiO_2$ PTC ceramics and heated approximately to 1200° C. for melting the glass. The melted substance can be shaped as desired in a mold according to the known glass molding process, and thereafter subjected, if necessary, to grinding or cutting with buff or diamond to obtain the desired shape and dimensions.

Figure 4:
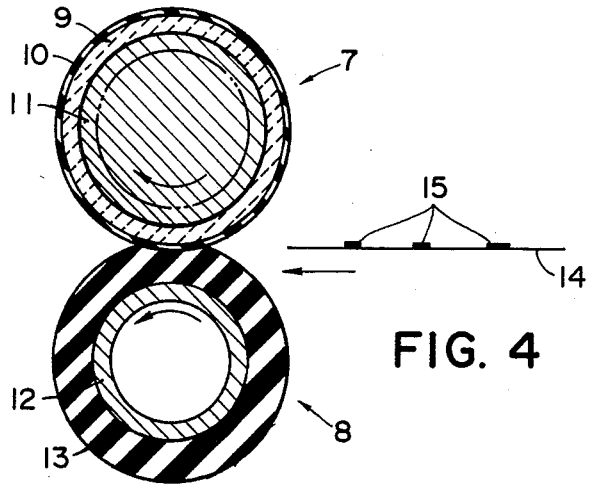
FIG. 4 is a schematic lateral cross-sectional view of an embodiment of the present invention.

FIG. 4 shows an embodiment of the present invention in a schematic lateral cross-sectional view, comprises a fixing roller 7 and a pressure roller 8. The fixing roller 7 is provided therein with a tubular heating element 9 to be explained later, and is peripherally covered by a heat-resistant thin release coating made for example of a tetrafluoroethylene resin or a silicone rubber. Said tubular heating element 9, if made rigid enough by the use of an inorganic binder such as glass, can itself constitute the substrate of the roller 7, but, when the heating element 9 is not rigid, said element 9 can be provided on a rigid substrate roller 11 for example made of a glass pipe or a stainless steel pipe. Naturally it is also possible to provide a rigid heating element on the above-mentioned substrate roller 11. The surface layer 10 may be coated, if necessary, with a releasing agent such as a silicone oil. The pressure roller 8 is made of a rigid pipe 12 made for example of a metal and covered with a thick layer of a heat-resistant elastic material such as a silicone rubber or a fluorinated rubber, and is maintained in pressure contact with the roller 7, whereby said layer 13 undergoes an elastic deformation to form a nip portion with said roller 7 for gripping a toner image bearing sheet 14 therebetween. Said sheet 14 is introduced into said nip and passes therethrough by the rotation of said rollers 7, 8, wherein the toner image 15 is melted by heating with the roller 7 and thus fixed onto said sheet 14. The toner image, so born on the sheet 14 as to face the roller 7 in the illustration, may also be positioned as to face the roller 8. The heating element 9 of the roller 7 receives a voltage supply as will be explained later to facilitate the electric insulation between said power supply and the roller drive source, it is preferable, as shown as a schematic elevational view in FIG. 5, to drive the roller 8 in the direction of the arrow by a motor 19 through transmitting means 18 such as a gear train, and to rotatably support the roller 7 by a frame 17 through insulating bearings 16 and to drive the same by friction in the direction indicated by the arrow. The roller 8 is supported by bearings 20 fixed on the frame 17. However, it is also naturally possible to drive the roller 7 and to rotate the roller 8 by friction, or to drive both rollers 7 and 8.

The above-explained fixing roller 7, having the heating element 9 immediately under the thin surface layer 10, shortens the heating time to the fixable temperature in comparison with the conventional heating devices in which the roller is heated by a halogen lamp located in the central cavity or is heated externally. As explained in the foregoing, said heating element 9 is composed of ceramic particles of PTC characteristic dispersed in a binder.

Figure 5:
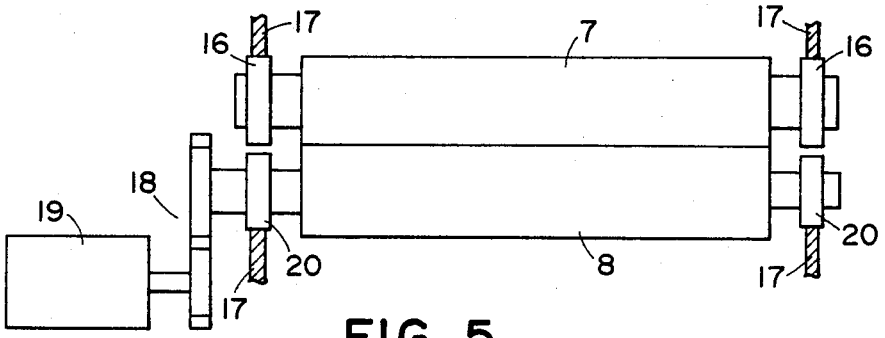
FIG. 5 is an elevational view of an embodiment of the present invention.

As already explained in the foregoing, the substrate roller 11 shown in FIGS. 4 and 5 can be dispensed with if the heating element is made rigid enough for supporting the entire roller by the use of a suitable binder such as glass. In another preferred embodiment the heating element 9 is also provided on the roller 8 to perform heating from both sides of the sheet.

Barium titanate ($BaTiO_3$) ceramics, known as representative of PTC ceramics, should preferably be so modified, in the use for a heat source in a fixing apparatus for a toner image, as to have a higher Curie temperature by the replacement of a part of barium sites with another element such as lead whereby the operational temperature for thermal fixation of the toner image onto the bearing member therefor can be selected close to the point of rapid resistance increase. As an example such ceramic material can be prepared by blending titanium oxide ($TiO_2$), barium carbonate ($BaCO_3$) and lead oxide (PbO or $Pb_3O_4$) or lead carbonate in an atomic molar ratio of Ti: Ba: Pb=1: (1−x): x where x is from 0.05 to 0.20, and treating the obtained mixture at a temperature of 1300° to 1400° C. The obtained barium titanate ceramic material has a Curie temperature within a range of 140° to 210° C., at which an ordinary toner can be fixed by heating onto the bearing sheet. Consequently in the present invention such PTC ceramics can be employed in crushed particle state, and the heating element 1 or 9 can perform a self temperature control function, if the operational temperatue is selected close to said Curie point.

In the foregoing examples, the aforementioned $BaTiO_3$ PTC ceramics Posister or PTH has a thermal expansion coefficient of $6-7\times10^{-6}$/° C. and a thermal conductivity of ca. $2\times10^{-3}$ cal/cm.deg.sec, while the binder Aron Ceramic D has a thermal expansion coefficient of $5-8\times10^{-6}$/° C. and a thermal conductivity of 0.11 ca./cm.deg.sec and the Pyrex glass binder has the factors of $3-6\times10^{-6}$/° C. and ca. $3\times10^{-3}$ cal/cm.deg.sec, respectively, so that it will be understood that the thermal expansion of these binders is close to that of the PTC ceramics employed. Consequently the heating and cooling of the heating element repeated over an extremely long period does not lead to a separation between the binder and the PTC ceramics nor to crack formation, so that a prolonged service life is ensured. Also the larger thermal conductivity of the Aron Ceramic D binder, larger than that of the PTC ceramics employed, reduces or eliminates the time-dependent temperature fluctuation on the surface of the heating element, thus enabling a satisfactory image fixation. A heating element 3 as shown in FIG. 1, if solely composed of the PTC ceramic bulk material, will result in an uneven temperature distribution between the surface portion and the internal portion because of poor thermal conductivity of said material, thus causing a time-dependent temperature fluctuation on the surface, but a structure of fine PTC ceramic particles dispersed in a thermally conductive binder allows faster thermal conduction through the heating element, thus preventing the above-mentioned fluctuation.

The PTC ceramic particles should preferably be provided with a diameter within a range from 50 to 200μ, since a diameter smaller than 50μ will lead to difficulty in molding due to deteriorated moldability and dispersibility inherent to such small particle size, while a diameter in excess of 200μ will lead to a reduced PTC effect since the specific resistivity increases in the dispersion due to the increased intra-particle distance. Nevertheless the particle size can be increased to as high as 3 mm. Also such PTC ceramic particles should preferably constitute at least 50 vol.% of the mixture with the binder, as a lower volume will lead to a reduced PTC effect.

Figure 6:
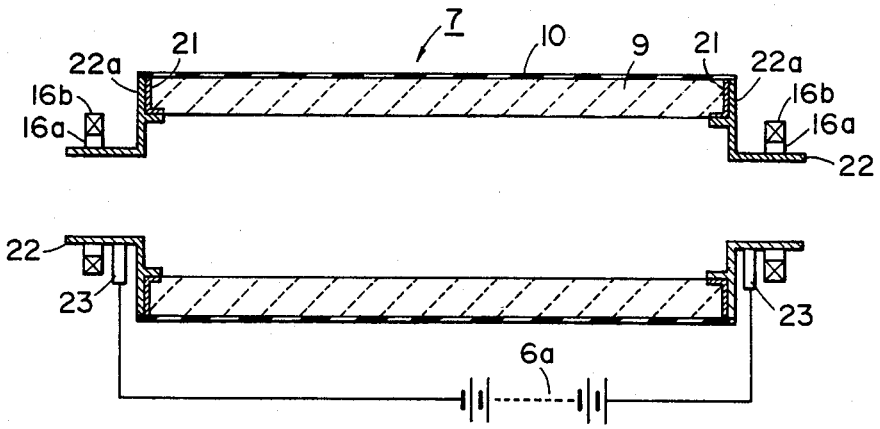
FIGS. 6 and 7 are schematic views showing the means for applying voltage to the heating element.

FIG. 6 is a longitudinal cross-sectional view of the fixing roller 7, showing the means for applying a voltage to the heating element. In the illustrated example, a rigid heating element 9 utilizing heat-resistant glass as binder constitutes the substrate roller, and is provided on both ends thereof with evaporated metal layers 21 composed for example of copper, silver or nickel, which are maintained in intimate contact with a flange portion 22*a* of a shaft member 22 made of aluminum or stainless steel. Said shaft member 22 is fitted in and thereby fixed to the heating element 9, and is supported, as aforementioned, by insulating bearings on the main frame. More specifically said shaft member is provided with insulating anti-abrasive sleeves 16*a* composed for example of a polyimide resin, which are fitted in ball bearings 16*b* fixed on the main frame. Further said shaft member 22 is maintained in sliding contact with a metal brush 23 constituting a brush contact, which is connected to a power supply 6*a* whereby a determined voltage is applied to the heating element 9 composed of PTC ceramic particles dispersed in a binder, thus obtaining a temperature required for thermal fixation of the toner image.

Voltage applying means as shown in FIG. 6 is also applicable to the aforementioned heating element 9 formed on the substrate roller 11.

Figure 7:
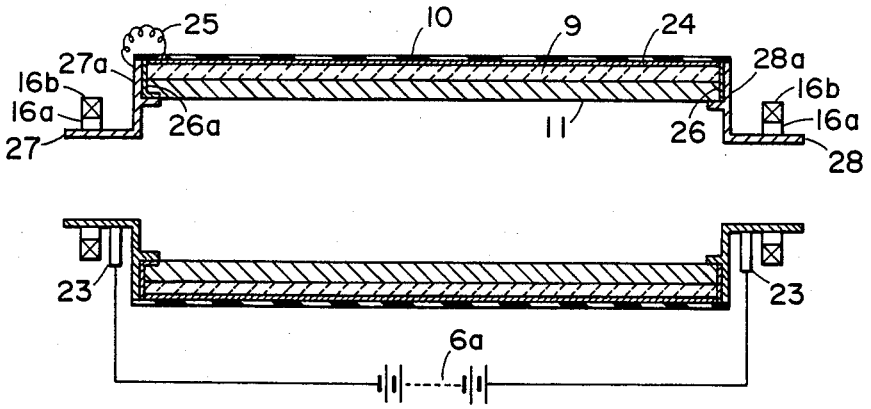

In place of voltage application in the longitudinal direction as shown in FIG. 6, the voltage may also be applied in the radial direction of the tubular heating element as shown in FIG. 7, wherein a heating element 9 utilizing Aron Ceramic D as the binder is formed around a tubular substrate roller 11 made of stainless steel, whereby said substrate roller 11 and heating element 9 are rendered mutually electrically conductive at the interface therebetween. The heating element is also provided on the external periphery thereof with an evaporated electrode layer 24 made for example of silver, copper or nickel, which is electrically connected through a wire 25 or other suitable means to a shaft member 27 fitted, through an insulating material 26*a*, in one end of the substrate roller 11.

Shaft members 27, 28 are made of a conductive material such as aluminum, and the latter is firmly fitted in direct contact with the internal wall of the substrate roller 11, whereby the shaft member 28 is electrically connected to the substrate roller 11 and is therefore capable of applying a voltage to the internal surface of the heating element 9. The end faces of the heating element 9 and the electrode layer 24 are electrically insulated from the shaft member 28 by means of an insulating material 26 for example an insulating paint. Also the shaft member 27 is electrically insulated from the end faces of the heating element 9 and the substrate roller 11 by means of an insulating material 26A such as an insulating paint.

Thus, by applying a voltage from the power supply 6*a* to the shaft members 27, 28 through the brush contacts 23 as shown in FIG. 6, the heating element 9 receives a voltage application in the radial direction to reach a temperature for the thermal fixation of the toner image. The electrode layer 24 is covered by a thin releasing layer 10. Such voltage application in the radial direction is also naturally possible in case the heating element itself constitutes the substrate roller. Furthermore, in the device shown in FIG. 4, the pressure roller may also be provided with said heating element in the same manner as explained in the foregoing with respect to the fixing roller 7.

Figure 8:
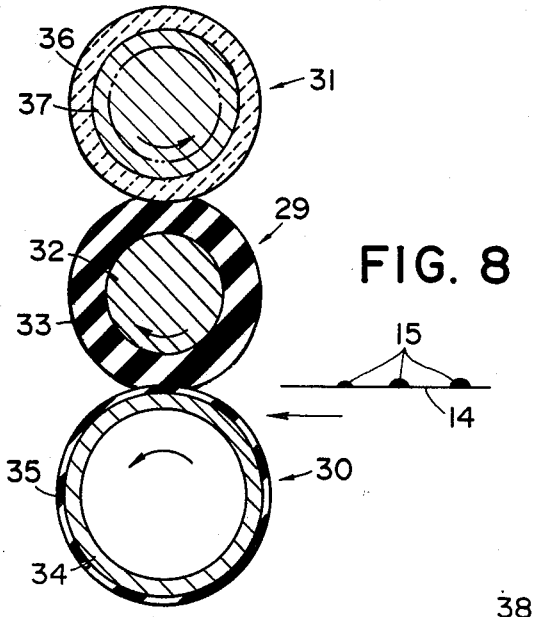
FIG. 8 is a schematic lateral cross sectional view of another embodiment of the present invention.

FIG. 8 shows another embodiment of the present invention comprising a fixing roller 29, a pressure roller 30 and a heating roller 31. The fixing roller 29 is composed of a rigid core 32 covered with a thick elastic covering 33 of releasing and heat-insulating characteristics made of silicone rubber or fluorinated rubber, while the pressure roller 30 is composed of a rigid core covered with a thin releasing covering 35 made for example of a silicone rubber or a tetrafluoroethylene resin. The rollers 29, 30 are rotated as indicated by the arrows in a mutually contacted state to transport the sheet 14 through the nip to fix the toner image thermally onto said sheet 14. The heating roller 31 is rotated in the direction of the arrow under pressure contact with the fixing roller 29, which heats the periphery of said fixing roller 29 to a temperature capable of fusing the toner image. Said heating roller is provided with a heating element 36 composed, in a similar manner as the aforementioned heating element 9, of PTC ceramic particles dispersed in a binder. Said heating element 36 is formed around a substrate roller 37 made of stainless steel or glass material, while said substrate roller 37 may be dispensed with in case a binder such as glass provides sufficient rigidity. Said heating element 36 is heated to a determined temperature by a voltage applied by suitable means as shown in FIGS. 6 and 7 to heat the roller 31 in the aforementioned manner. Said heating element 36 may be provided on the periphery thereof with a thin releasing coating composed for example of a silicone rubber or a tetrafluoroethylene resin. Also the surface bearing the toner image 15 of the sheet 14 may be so positioned, contrary to the arrangement shown in FIG. 8, as to face the roller 30. Furthermore said roller 30 may also be provided with a heating element similar to the aforementioned heating element 30, for further increasing the fixing speed.

Figure 9:
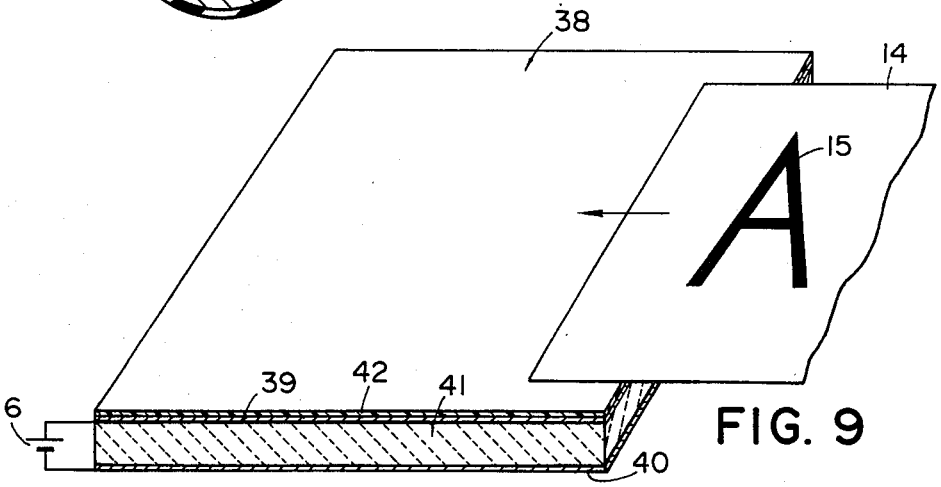
FIG. 9 is a schematic view of still another embodiment of the present invention.

FIG. 9 shows still another embodiment of the present invention wherein a heating plate 38 comprises a heating element 41 composed, as already explained in the foregoing, of PTC ceramic particles dispersed in a binder but molded as a plate. Said heating element is provided on the top and bottom faces thereof with evaporated metal electrode layers 39, 40 made for example of copper, silver or nickel, wherein said electrode layer 39 is covered with a low-friction heat-resistant coating 42 composed for example of a tetrafluoroethylene resin. Said electrode layers 39, 40 receive a determined voltage from a power source 6 whereby the heating element 41 is heated to a temperature allowing thermal fixation of the toner image 15 onto the sheet 14. Said sheet 14 is so transported that the surface thereof not bearing the toner image 15 comes into contact with said layer 42, and the toner image heated by the heating plate 38 is fixed thereon. Said sheet 14 may also be so transported as to be separated from but in facing relation to the heating plate 38 whereby the toner image is fixed by heat radiation. In such case the surface of the sheet 14 bearing the toner image 15 may be positioned so as to face the heating plate 38, and the aforementioned releasing layer 42 may be dispensed with in certain cases. Also in contrast to the voltage application in the thickness direction of the heating element 41, it is also naturally possible to apply a voltage in a direction perpendicular to said thickness direction, such as a direction parallel to the transporting direction of the sheet 14 or the width direction of said sheet.

Although the foregoing embodiments are limited to the devices for toner fixation by thermal fusion, the present invention is also applicable to a fixing device designed for fixing toner to the bearing sheet principally by pressure by pressurizing the same between paired rollers with a pressure ordinarily at least equal to 10 kg/cm of the longitudinal length of said roller and auxiliarily applying heat to the toner and the bearing sheet. In such a case the heat to be supplied to the toner can be less than that in thermal fusion fixation, so that the PTC ceramic material to be dispersed in the binder can be composed of a pure $BaTiO_3$ ceramic material having a Curie temperature of ca. 120° C. or a $BaTiO_3$ ceramic material with a lowered Curie temperature in which a part of Ba sites is substituted by strontium or other suitable elements.

Also in order to have a higher Curie temperature, the heating element can be composed of a $BaTiO_3$ PTC ceramic particles in which a part of barium sites is substituted by lead or other suitable elements.

As the heating element in the foregoing embodiments is composed of a ceramic material of PTC characteristic dispersed in a binder, it is rendered possible to obtain not only a uniform heat distribution but also an arbitrary heat distribution. As an example, the fixing roller in a fixing device tends to lose heat more quickly in the end portions than in the central portion. In order to prevent such phenomenon and to achieve a more uniform heat distribution, the amount of the PTC ceramic material can be increased in said end portions or decreased in the central portion. Naturally heat distribution of other forms can be achieved arbitrarily and easily in the similar manner.

As explained in detail in the foregoing, the heating element of the present invention, showing a PTC characteristic similar to that of a PTC semiconductor ceramic material and being free from cracks or qualitative unevenness even in a large-sized element, allows uniform surface heat generation and a desired amount of heat to be obtained. Also the satisfactory working property assures the preparation of a heating element of desired shape and dimension with a low cost.

Also said heating element, utilizing the PTC ceramics in the form of particles dispersed in a binder, is uniform and free from cracks, thus enabling uniform image fixation by a heat source in the image fixing device. Satisfactory fixation is also enhanced by the possibility of precise molding in desired shapes and dimensions, and the ease of molding leads to a low-cost fixing device.

What we claim is:

1. A heating device comprising:

a heat generating element including a non-organic binder having dispersed therein and in electrically contacting state ceramic particles which have PTC characteristics, said element being formed by pulverizing ceramic sintered so as to have PTC characteristics, dispersing said PTC particles in said binder, and being incorporated at a temperature lower than the sintering temperature so as integrally to form the element while retaining the binder therein; and electrical means for applying a voltage across said heat generating element to cause heat generation without dissipation of the binder, wherein said heating device provides a substantially uniform heat distribution.

2. A device according to claim 1, wherein said particles have particle size of not more than 3 mm.

3. A device according to claim 2, wherein said particles have particle size of not less than 50μ but not more than 200μ.

4. A device according to claim 1, wherein the inorganic binder is an insulating binder having, as a main component, alumina.

5. A device according to claim 1, wherein said inorganic binder is heat-resistive glass.

6. A heating device according to claim 1, wherein said heat generating element is a heat generating layer of a first roller and said device further includes a second roller for transporting a supporting member through a nip formed between said first and second rollers for fixing a toner image on the supporting member, and means for rotating at least one of said first and second rollers.

7. A device according to claim 6, wherein said second roller is provided with a heat generating layer including ceramic particles made from pulverized ceramic having PTC characteristics and a binder dispersing the ceramic particles therein.

8. A heating device according to claim 1, wherein said heat generating element is a heat generating layer of a first roller and wherein said device further includes:

second and third rollers for transporting a supporting member through a nip formed therebetween, said second roller being heated by said first roller to fix a toner image on the supporting member; and means for rotating at least one of said first, second and third rollers.

9. A device according to claim 8, wherein at least one of said second and third rollers is provided with a heat generating layer including ceramic particles made from pulverized ceramic having PTC characteristics and a binder dispersing the ceramic particles therein.

10. A device according to claim 6 or 8, wherein said voltage applying means has electrodes for voltage application at the longitudinal ends of said first roller.

11. A device according to claim 6 or 8, wherein said voltage applying means includes electrodes at exterior and interior surfaces of said heat generating layer of said first roller.

12. A device according to claim 6 or 8, wherein said ceramic particles have particle size of not more than 3 mm.

13. A device according to claim 12, wherein said particles have particle size of not less than 50μ, but not more than 200μ.

14. A device according to claim 6 or 8, wherein the inorganic binder is an insulating binder having, as a main component, alumina.

15. A device according to claim 6 or 8, wherein said inorganic binder is heat-resistive glass.

16. A device according to claim 6 or 8, wherein said first roller has a top releasing layer.

17. A device according to claim 6 or 8, wherein said binder of the heat generating layer of the first roller is of a releasing nature.

18. A device according to claim 17, wherein the thermal conductivity of the binder is substantially the same as that of the ceramic particles.

19. A device according to claim 17, wherein the thermal conductivity of the binder is greater than that of the ceramic particles.

20. A heating device according to claim 1, wherein said heat generating element is a heat generating layer of a plate-like heating member for generating heat to fix a toner image on a supporting member.

21. A device according to claim 20, wherein said voltage applying means has electrodes for applying voltage or current across the thickness of the heat generating layer.

22. A device according to claim 20, wherein said voltage applying means has electrodes for applying voltage or current in a direction transversing the thickness of the heat generating layer.

23. A device according to claim 20, wherein said particles have particle size of not more than 3 mm.

24. A device according to claim 23, wherein said particles have particle size of not less than 50$\mu$ but not more than 200$\mu$.

25. A device according to claim 20, wherein the inorganic binder is an insulating binder having, as a main component, alumina.

26. A device according to claim 20, wherein said inorganic binder is heat-resistive glass.

27. A device according to claim 20, wherein said plate has a releasing layer on the side of said heat generating layer opposing the supporting member.

28. A device according to claim 20, wherein the binder of said heat generating layer has a releasing nature.

29. A device according to claims 1, 6, 8 or 20, wherein the thermal conductivity of the binder is substantially the same as that of the ceramic particles.

30. A device according to claim 1, 6, 8 or 20, wherein the thermal conductivity of the binder is greater than that of the ceramic particles.

31. A device according to claim 1, wherein said heat generating element is roller-shaped.

32. A device according to claim 1, wherein said heat generating element is plate-shaped.

* * * * *